US005287832A

United States Patent [19]

Uhl

[11] Patent Number: 5,287,832

[45] Date of Patent: Feb. 22, 1994

[54] STARTING DEVICE FOR AN INTERNAL COMBUSTION ENGINE

[75] Inventor: Klaus-Martin Uhl, Esslingen, Fed. Rep. of Germany

[73] Assignee: Andreas Stihl, Waiblingen, Fed. Rep. of Germany

[21] Appl. No.: 966,435

[22] Filed: Oct. 26, 1992

[30] Foreign Application Priority Data

Oct. 26, 1991 [DE] Fed. Rep. of Germany ..... 4135405

[51] Int. Cl.[5] ..... F02N 3/02

[52] U.S. Cl. ..... 123/185.3; 74/7 C

[58] Field of Search ..... 123/185.2, 185.3, 185.4, 123/179.29; 74/7 C; 192/42, 41 S

[56] References Cited

U.S. PATENT DOCUMENTS 4,019,490 4/1977 Reese ..... 123/185.3
4,127,098 11/1978 Prers et al. ..... 123/185.2
4,480,605 11/1984 Bloemers ..... 123/185.3
4,641,614 2/1987 Krebs ..... 123/185.2
4,658,775 4/1987 Greenwood et al. ..... 123/185.3
4,848,288 7/1989 Murase et al. ..... 123/179.24
5,063,812 11/1991 Mercier ..... 123/185.2

*Primary Examiner*—Tony M. Argenbright
*Assistant Examiner*—M. Macy
*Attorney, Agent, or Firm*—Walter Ottesen

[57] ABSTRACT

The invention is directed to a starting device for manually starting an internal combustion engine and especially a two-stroke engine. The starting device comprises essentially a clutch drum which is actuated by a pull rope for imparting rotation to a catch which coacts with a clutch element of the engine shaft. The starting device maintains within limits the effects of stronger fluctuations of the reaction torque of the engine shaft on the hand of the operator. This is achieved in that the clutch drum and the carrier of the catch are configured as separate parts and are connected by an elastically-deformable entraining element which takes up the force peaks of the reaction torque.

36 Claims, 6 Drawing Sheets

STARTING DEVICE FOR AN INTERNAL COMBUSTION ENGINE

FIELD OF THE INVENTION

The invention relates to a starting device for an internal combustion engine such as a pull-rope starting device for a two-stroke engine.

BACKGROUND OF THE INVENTION

A starting device of the above kind is disclosed in U.S. Pat. No. 4,127,098. The operation of such a starting device often presents difficulties because periodically high reaction forces occur as a result of the compression in the engine during starting. This causes changing forces which are temporarily very high to act on the hand of the operator. The force peaks acting on the handle of the starting device are that much greater the lighter the rotating masses of the engine are.

It is known for pull-rope starting devices for internal combustion engines that the periodically occurring high reaction forces can be prevented when the rope is wound on an oval or cornered disc of the clutch drum so that different pulling forces result when pulling the handle while unwinding the rope. These pulling forces are adapted to the fluctuating reaction torque. In this connection, reference can be made to U.S. Pat. Nos. 2,942,599 and 3,814,073. The arrangement requires a precise dimensioning, assembly and correlation of the winding of the rope disc in dependence upon the engine to be started. The constructive and manufacturing complexity for a starting device of this kind is therefore very great.

SUMMARY OF THE INVENTION

It is an object of the invention to provide a starting device wherein the transfer of the especially intense reaction forces, which are caused by the compression of the internal combustion engine, on the handle of the starting device is reduced and wherein, as a consequence, the starting operation is facilitated.

The starting device of the invention is for applying a starting torque to the shaft of an internal combustion engine with the engine developing a reaction torque during starting which causes the starting torque to fluctuate. The starting device includes: a housing; a clutch drum rotatably journalled in the housing and defining an axis of rotation; means for manually imparting a rotational movement to the clutch drum; a clutch member fixedly mounted to the engine shaft for rotation therewith; a carrier rotatably mounted in the housing so as to be rotatable about the axis; entraining means for connecting the clutch drum to the carrier for transmitting the rotational movement of the clutch drum to the carrier; catch means mounted on the carrier and being displaceable in response to the rotational movement from a rest position into an engaging position wherein the catch means engages and transmits the rotational movement to the clutch member; and, the entraining means being elastically deformable to compensate for the fluctuations of the starting torque.

The starting device according to the invention departs from the starting device disclosed in U.S. Pat. No. 4,127,098 in that the clutch drum of the starting device of the invention is not also the carrier of the catch which is brought into engagement with the clutch member of the engine shaft. Instead, this carrier is configured as a separate part and connected to the clutch drum via an elastic deformable entraining device whereby fluctuations of the torque to be applied to the engine shaft are compensated. If the reaction torque increases beyond a specific value because of the compression in the engine, then the rotational movement of the carrier of the catch is delayed with reference to the rotational movement of the clutch drum since the entraining element elastically deforms opposite to the rotational movement. The catch is connected to the clutch member of the engine shaft so as to rotate therewith. The clutch drum therefore continues to be rotated with the same speed without the need for an increased force. The deformation forces are stored in the entrainment element as energy which is released during reduced reaction torque and therefore supports the continued rotational movement of the clutch drum and of the catch carrier. The resilient entrainment of the catch carrier operates in the desired manner to even out the force which must be exerted on the handle for the starting operation. Furthermore, construction and manufacturing complexity is minimal because only the clutch drum and the carrier of the catch must be produced as separate parts while interposing the elastically deformable entraining element while all other parts of the starting device remain unchanged.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
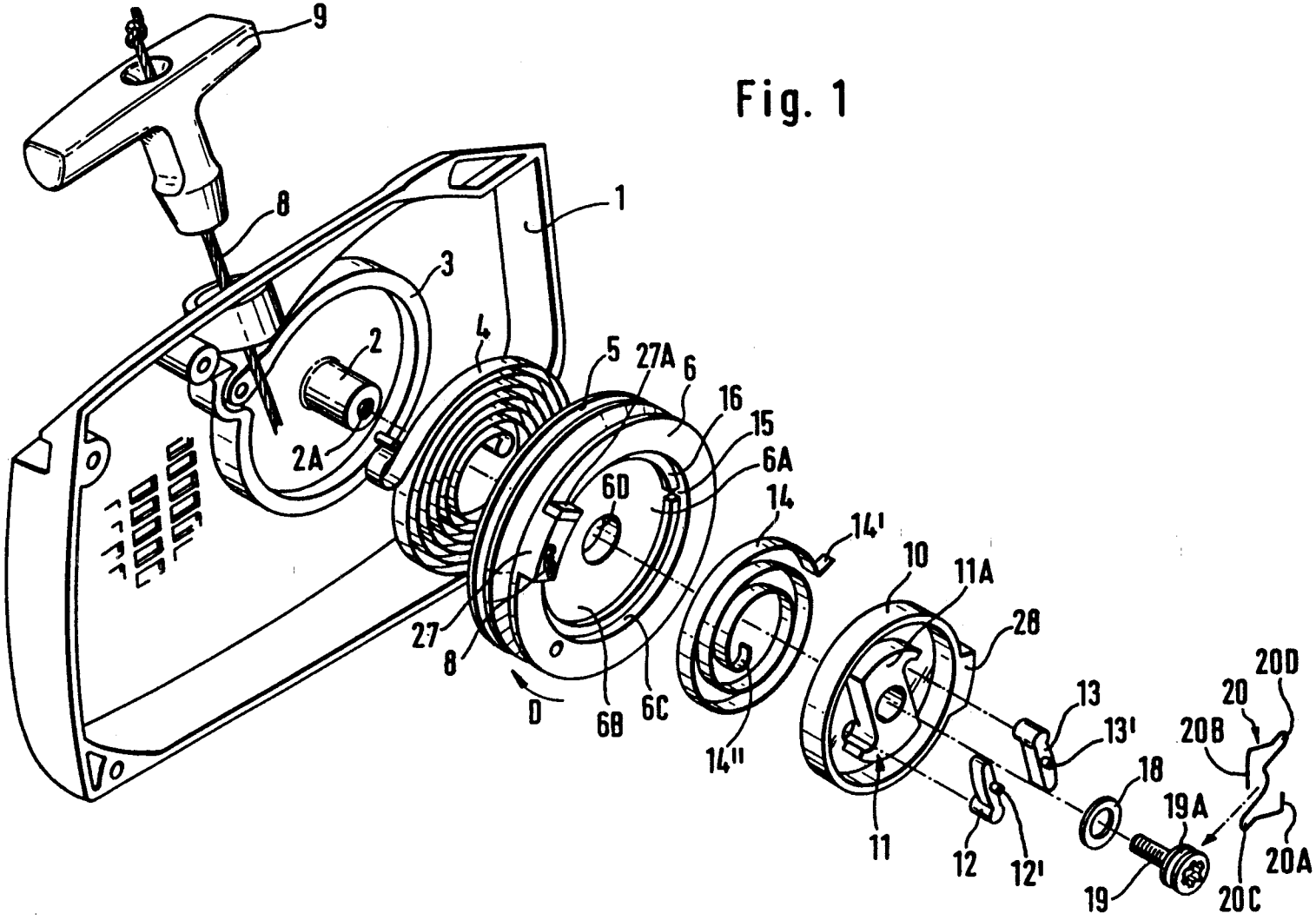
FIG. 1 is an exploded view of the starting device according to the invention.

The starting device of FIG. 1 is provided for manually starting a two-stroke engine which is mounted for example in a motor-driven chain saw. The starting device is mounted in a housing 1 which is configured as a removable cover of the motor housing with the cover being provided with ventilating slots. A bearing lug 2 is mounted in the inner wall of the housing 1 and is surrounded by a spring housing 3 formed on the housing. A spiral spring 4 is disposed in the housing 3 and is firmly held at one end on the edge of this housing. The spiral spring is covered by a metal disc 5 and acts as a return spring for a clutch drum 6 configured as a rope drum. The clutch drum 6 has a rearward lug 7 (FIG. 5) which projects through a center bore of the metal disc 5 into the spring housing 3. The lug 7 shown in FIG. 5 has an axial slit 7' for the engagement of the inner end of the spiral spring 4. A rope 8 is wound on the clutch drum 6 and has a free end brought out of the housing 1 with this free end being attached to a handle 9. By pulling on the rope by means of the handle, the clutch drum 6 is set into rotational motion about the bearing lug 2 while the rope unwinds.

The clutch drum 6 has a circularly-shaped receiving space 6A surrounding the bearing lug 2. The receiving space 6A is for a cup-shaped carrier 10 of a catch 11 which has two pivotally-journalled pawls 12 and 13. An elastically deformable entraining element 14 is disposed between the carrier 10 and the end wall 6B of the clutch drum 6 delimiting the receiving space 6A. The entraining element 14 in the embodiment of FIG. 1 is configured as a spiral spring. The outer end 14' of the spiral spring is hooked into a slit 15 which is provided in a ring-shaped shoulder 16 of the inner wall 6C of the clutch drum 6. This shoulder 16 surrounds the spiral spring 14 and the outer turn of this spring lies against the inner wall of the shoulder 16. The catch carrier 10 is rotatably journalled on the bearing lug 2 (FIG. 1).

Figure 4:
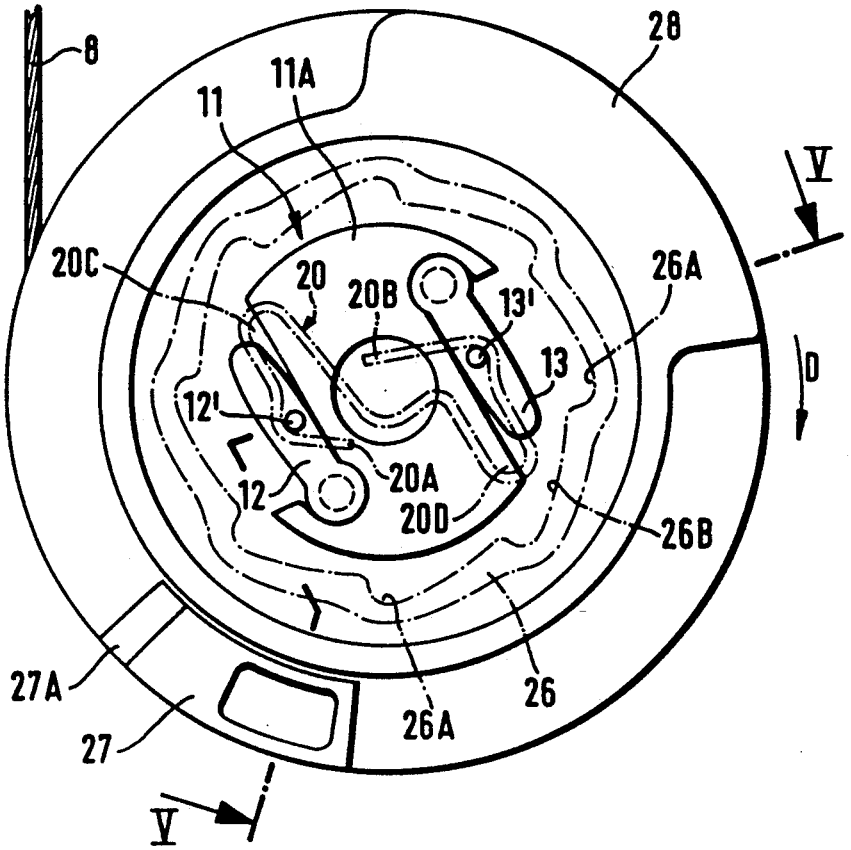
FIG. 4 is a plan view of the clutch drum of the starting device of FIG. 1 with the catch seated in place.
Figure 5:
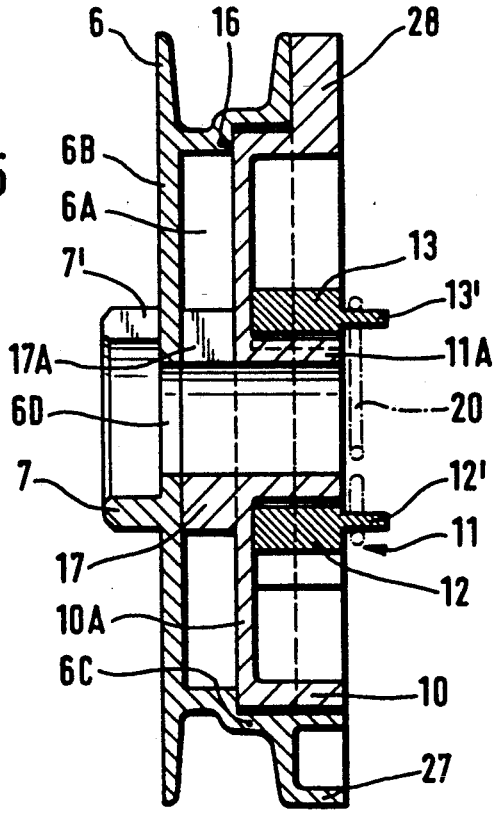
FIG. 5 is a section view taken along line V—V of FIG. 4.

The clutch drum 6 is journalled on the catch carrier 10. The shoulder 16 of the clutch drum 6 has an end face defining a sliding surface (FIG. 5). The catch carrier 10 has an entraining projection 17 (FIG. 5) which is centrally disposed and is spirally configured at the periphery. The projection 17 extends from the base 10A of the carrier 10 toward the end wall 6B of the clutch drum 6 and delimits the ring-shaped receiving space 6A in this region on the inner side. The inner end section of the spiral spring 14 lies on the entraining projection 17. The inner end of the spiral spring 14 is hooked into an axial slit 17A of the entraining projection 17 (FIGS. 1 and 5). A bearing mount 11A of the catch 11 is disposed on the base 10A of the carrier 10 and is configured as a single piece therewith. Two pawls 12 and 13 have respective thickenings whereat they are pivotally seated in this bearing mount 11A as shown in FIGS. 1, 4 and 5. The pawls 12 and 13 have respective lugs 12' and 13' which are directed outwardly.

In the mounted condition of the starting device, the bearing lug 2 fixed to the housing extends through a center bore 6D of the end wall 6B of the clutch drum 6 and the carrier 10. The entraining projection 17 of the carrier 10 and bearing mount 11A conjointly define a bushing-shaped receptacle for the bearing lug 2. A threaded bolt 19 is threadably engaged in an axial thread 2A of the bearing lug 2. An annular slot 19A is provided in the head of the threaded bolt 19 as shown in FIG. 1. A guide bracket 20 made of spring steel wire is seated in the annular slot 19A. The bracket 20 has two free legs 20A and 20B which engage around respective ones of pawl lugs 12' and 13' in the rest position of the clutch drum (FIG. 4). The end of the free leg 20B as well as the mid segment of the guide bracket 20 lie in the annular slot 19A. The guide bracket 20 has hairpin-shaped ends 20C and 20D wherein corresponding ones of pawl lugs 12' and 13' are disposed. A washer 18 is disposed between the guide bracket 20 and the bearing mount 11A of the catch 11 and is in surrounding relationship with respect to the head of the threaded bolt 19. The washer 18 ensures an undisturbed relative rotation between the guide bracket 20 and the bearing mount 11A.

Figure 2:
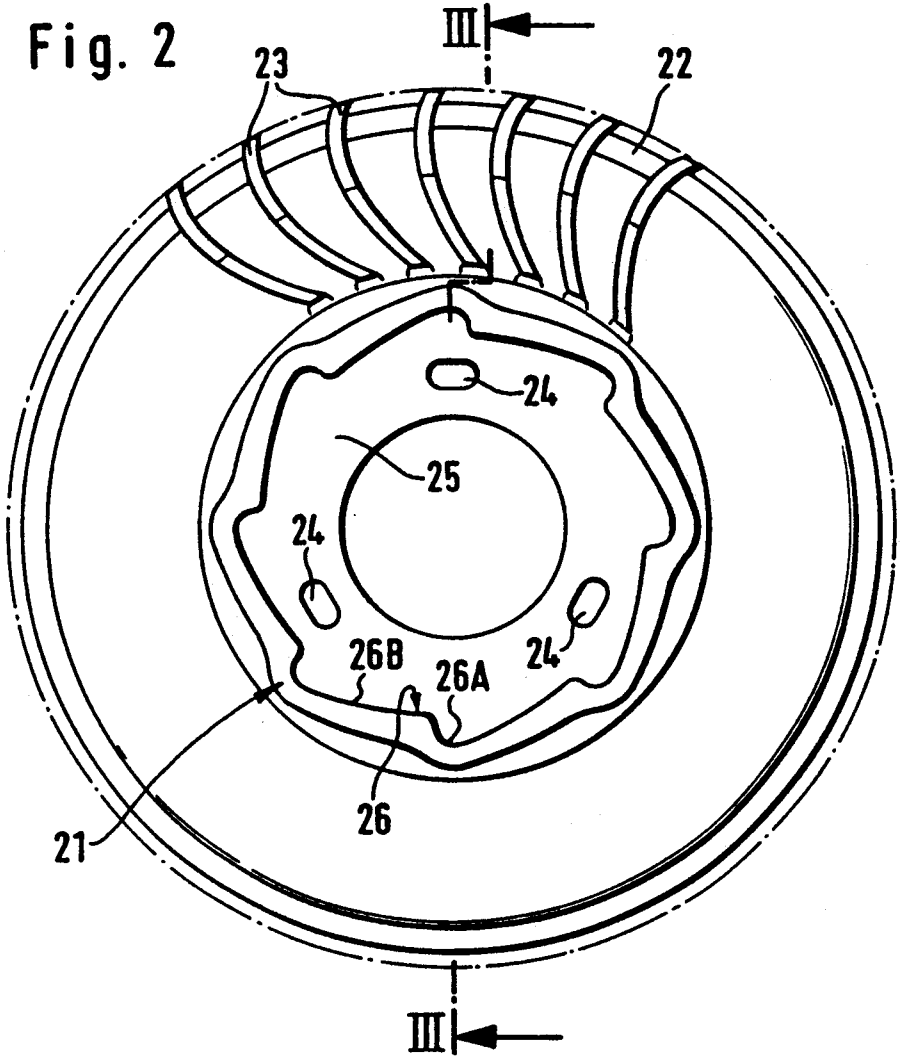
FIG. 2 is a plan view of a clutch shell which is attached to the drive shaft of the engine.
Figure 3:
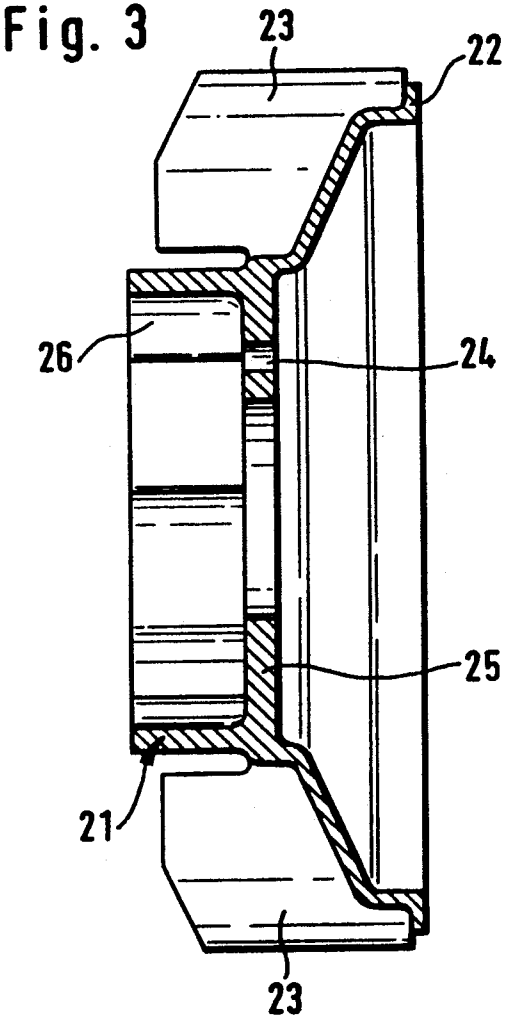
FIG. 3 is a section view taken along line III-III of FIG. 2.

The rotational movement of the clutch drum 6 is transmitted to a clutch element which is fixedly connected to the motor shaft to be driven so as to rotate therewith. In the embodiment shown in FIGS. 2 and 3, the clutch element is a clutch shell 21 configured as a single piece with the fan wheel 22 having vanes 23 arranged in a wreath-like manner around the wheel as shown. The clutch shell 21 has through openings 24 in the base 25 thereof for accommodating screws (not shown) with which the clutch shell is attached to a flange of the crankshaft of the two-stroke engine (not shown). It is however also possible to configure the clutch shell as one piece having a hub cast thereon for connecting to the crankshaft so as to rotate therewith, for example, by a Woodruff key. The inner wall of the clutch shell 21 is provided with teeth 26 with which the clutch shell 21 engages in the cup-shaped catch carrier 10 after the assembly of the starting device as shown in phantom outline in FIG. 4.

When the rotation is imparted to the clutch drum 6 by pulling on the rope 8, the clutch drum entrains the carrier 10 of the catch via the spring 14. The bearing mount 11A of the catch 11 then rotates about the bearing lug 2 while the guide bracket 20 at first retains its position since the bracket is frictionally held to the threaded bolt 19 and therefore to the bearing lug 2. The lugs 12' and 13' of the two pawls 12 and 13, respectively, are caused thereby to wander outwardly in the hairpin bends 20C and 20D, respectively, in a direction toward the end of the bends whereby the pawls 12 and 13 pivot outwardly. In this outwardly pivoted position, the pawls entrain the guide bracket 20 which then rotates against the friction resistance in the annular slot 19A of the threaded bolt 19 about the axis of the bearing lug 2. With a further rotation of the clutch drum 6 and therefore of the catch 11 (shown in FIG. 4 in clockwise direction D), the pawls 12 and 13 remain in their outwardly-pivoted positions and then engage in respective tooth gullets 26A of the teeth 26. In this way, rotation is imparted to the clutch shell 21 (FIGS. 2 and 3) and therefore also to the engine shaft to be driven. When the engine has started running and the pregiven rotational speed is reached, the clutch shell 21 with its teeth 26 overtakes the catch 11 with the pawls 12 and 13 being pivoted back along the teeth at the flanks 26B. Also for every start operation after releasing the handle 9, the pawls are returned to their initial positions during the return rotation of the clutch drum 6 under the control of the guide bracket 20.

The compression of the engine increases up to top dead center of the piston when rotating the engine shaft and falls off again. The reaction torque periodically fluctuates correspondingly, which is effective as high force peaks for the conventional starting devices, which must be developed when starting. To compensate for this periodic change for this force to be developed, the elastically deformable entraining element is provided which is configured as a spiral spring 14 in the embodiment of FIG. 1. The spring 14 is so dimensioned that it entrains the carrier 10 of the catch 11 with the rotational speed of the clutch drum 6 as long as the reaction torque of the engine shaft remains below a pregiven limit value. The piston of the engine therefore is in the region forward and rearward of its dead-center position. With an increase in the reaction torque above this limit value, the spiral spring 14 deforms by closing its turns so that the rotational speed of the catch carrier reduces while the clutch drum 6 can be rotated further at the same rotational speed and approximately with the same force being exerted. The clutch drum 6 then rotates in the rotational direction D (FIGS. 1 and 4) additionally relative to the catch carrier 10 which is seated with slight play in the clutch drum. The height of the spiral spring 14 made of a flat strip steel is so dimensioned that the base 10A of the carrier 10 is not continuously in contact with the spring. The intermittent contact of the spiral spring 14 on the carrier base 10A is possible which provides a guard against axial displacement of the spring turns. A stop 27 is formed at the outer flange of the clutch drum in order to limit the relative movement between the clutch drum 6 and the catch carrier 10. A counter stop 28 is provided on the carrier 10 for the stop 27 as shown in FIGS. 1 and 4. The stop 27 includes a buffer 27A of rubber-elastic material at its forward end viewed in the direction D.

When the reaction torque again drops below the pregiven limit value after passing top dead center of the engine piston, the spiral spring 14 relaxes to its start position with the catch carrier 10 entrained by the spring moving relative to the clutch drum 6 in the direction D. The spiral spring 14 therefore acts simultaneously as an energy store which supplies energy to the carrier 10 which was stored during the previous deformation and in this way accelerates the carrier 10 so that the carrier 10 reaches for a short time an absolute rotational speed greater than the clutch drum and can then again rotate at the speed of the clutch drum.

The return spring 4 is provided for returning the clutch drum 6 into its start position so that the rope 8 can be rewound after being pulled from the clutch drum as is conventional with a pull-rope starting device. Only a slight friction develops between the spring housing 3 and the clutch drum during the rotational movement of the latter because the spring housing 3 is covered by the metal disc 5.

Figure 6:
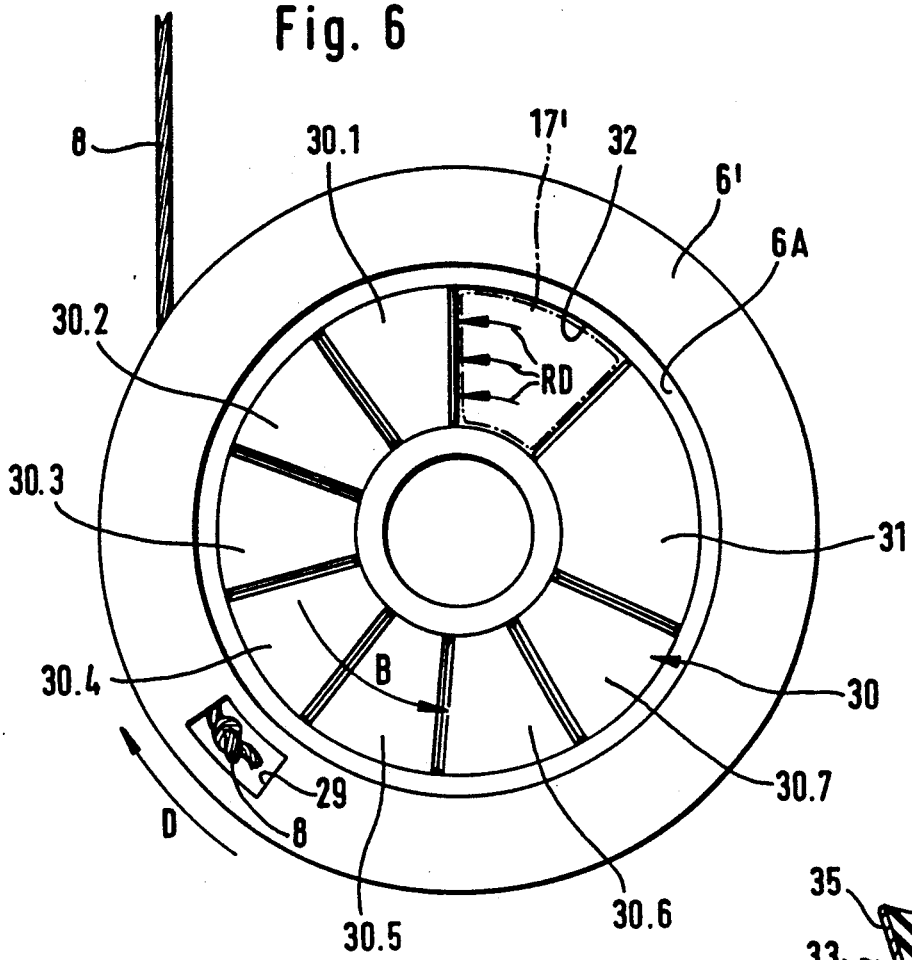
FIG. 6 is a plan view of another embodiment of the clutch drum.
Figure 8:
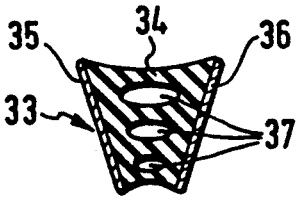
FIG. 8 shows an embodiment of a rubber-elastic body for an entraining element for use with the clutch drum of FIG. 6.
Figure 7:
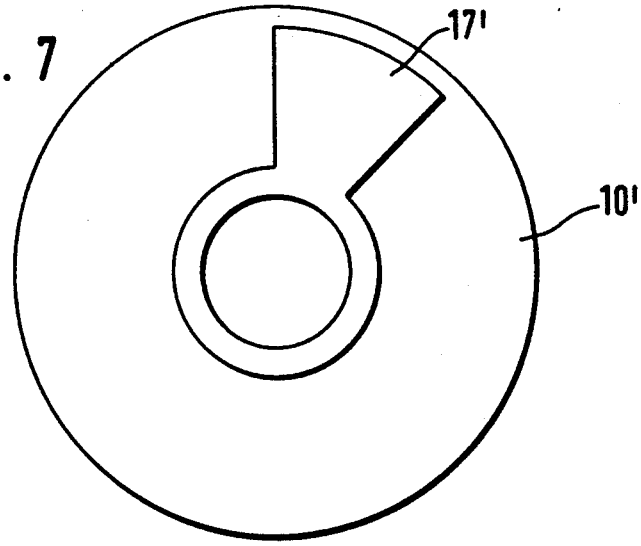
FIG. 7 is a rear view of a carrier for the catch with the carrier fitting into the clutch drum of FIG. 6.

FIGS. 6 to 8 show another embodiment of the elastically-deformable entraining element with the clutch drum and the catch carrier being correspondingly adapted.

In the plan view of FIG. 6, the outer flange and the ring-shaped receiving space 6A of the clutch drum 6' can be seen. The flange has no projection corresponding to the stop 27 of FIG. 1 so that the end of the rope 8 is not guided through such a stop as in FIG. 1; instead, the rope is provided with a knot at a corresponding pass-through opening 29 of the flange.

A part ring-shaped entraining element 30 made of an elastomer is disposed in the ring-shaped receiving space 6A. The entraining element 30 in this embodiment comprises seven rubber-elastic bodies 30.1 to 30.7 which have a shape corresponding to a truncated sector of a circle as shown in FIG. 6. The rubber-elastic bodies are arranged so that they lie one next to the other with their side surfaces. The bodies 30.1 to 30.7 have rounded edges and adequate play within the receiving space 6A so that they can each individually deform elastically. The rubber-elastic body 30.7 adjoins a rigid filler body 31 which is rigidly connected to the clutch drum 6' and can be configured as a single piece therewith. A chamber 32 which opens outwardly is left free between the filler body 31 and the elastic body 30.1. The chamber 32 likewise has a shape corresponding to a truncated sector of a circle as shown in FIG. 6. In this embodiment, a catch carrier 10' is provided having an entraining projection 17' on its rearward wall (FIG. 7) which likewise has a shape corresponding to a truncated sector of a circle and fits into the chamber 32. The entraining projection 17' is shown in phantom outline in FIG. 6.

If the clutch drum 6' is rotated in the direction D for the starting operation, then the corresponding torque is transmitted from the fill body 31 to the entraining projection 17' of the catch carrier 10' via the rubber-elastic entraining element 30. The reaction torque of the engine shaft then acts in the direction of arrows RD on the first rubber-elastic body 30.1 and, via this body, on the rubber-elastic bodies which follow so that the entraining element 30 is loaded against the filler body 31 in the direction B. If the reaction torque RD exceeds the pregiven limit value, then the rubber-elastic body 30.1 is first deformed and, with a further increase of the reaction torque, the additional rubber-elastic bodies 30.2 to 30.7, which follow sequentially, deform. The entraining element 30 then stores energy which this element supplies to the entraining projection 17' during the subsequent load relaxation and thereby can supply this energy to the catch carrier 10'.

The rubber-elastic bodies 30.1 to 30.7 all have the same shape but can be configured differently and, with a suitable selection of material, they can define different characteristics of this elastomeric spring.

FIG. 8 shows an embodiment of the rubber-elastic bodies 30.1 to 30.7. A rubber element 34 is held in a holder 33 which comprises two mutually adjacent plates 35 and 36. The rubber element 34 is preferably attached by vulcanization to the plates 35 and 36. Recesses 37 are provided in the rubber element 34 for obtaining a pregiven form elasticity. The plates 35 and 36 are advantageously made of plastic and contribute to the uniform transfer of the reaction torque RD.

Additional embodiments for the elastically-deformable entraining element are shown in FIGS. 9 to 12.

Figure 9:
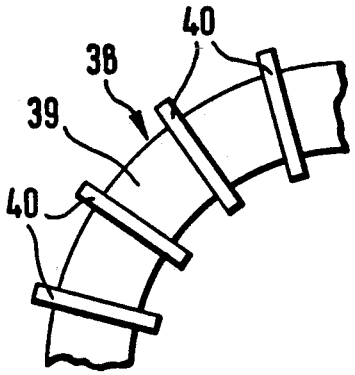
FIG. 9 is a detail view of a portion of an alternate embodiment of an elastic entraining element.

A ring-shaped rubber elastic band 39 is provided as an entraining element 38 in FIG. 9. Individual carrier rings 40 in spaced relationship to each other are attached to band 39. In this embodiment, an end carrier ring is attached to the entraining projection of the catch carrier and the other end carrier ring is connected to the clutch drum in such a manner that the elastic band 39 is stressed in tension with the carrier rings 40 acting as slide bearings. In this case, an outer stop corresponding to the embodiment of FIG. 1 must be provided in order to avoid overexpanding the band. It is, however, also possible to select the material and the thickness of the rubber-elastic band 39 so that the entraining element 38 is stressed with pressure. The band 39 between the carrier rings 40 is then compressed. As soon as the band completely fills out the space left free for its deformation, a further relative movement between the clutch drum and the catch carrier is no longer possible in the loading direction B (FIG. 6) because rubber is incompressible so that an additional stop is not needed as is the case in the embodiment of FIG. 6.

Figure 10:
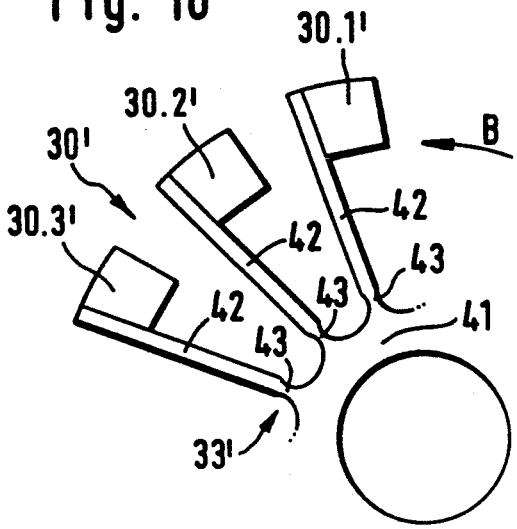
FIG. 10 is another partial detail view of another embodiment of an elastic entraining element.

FIG. 10 shows a holder 33' for the rubber-elastic bodies of which only three bodies 30.1', 30.2' and 30.3' are shown. These rubber-elastic bodies are configured to have a block-like shape and with the holder 33' conjointly define an entraining element 30'. The holder comprises a ring-shaped carrier body 41 having rods 42 projecting radially outwardly on which respective rubber-elastic bodies 30.1, 30.2' and 30.3' are attached at a spacing from the next adjacent body.

It is advantageous to make the holder 33' of plastic and thereby form elastic. The rods 42 extend into the carrier body 41 with the respective joints 43 so that they can pivot toward each other under the elastic deformation of the plastic. When the entraining device 30' is loaded in the direction B, the rubber-elastic body 30.1' is first elastically deformed and thereafter the corresponding rod 42 pivots in the direction B until this rod strikes the rubber-elastic body 30.2' which is likewise deformed with increasing reaction torque so that the pivot movements which follow one another continue up to the last rod. The rod 42 having the rubber-elastic body 30.1' moves the longest distance.

Figure 11:
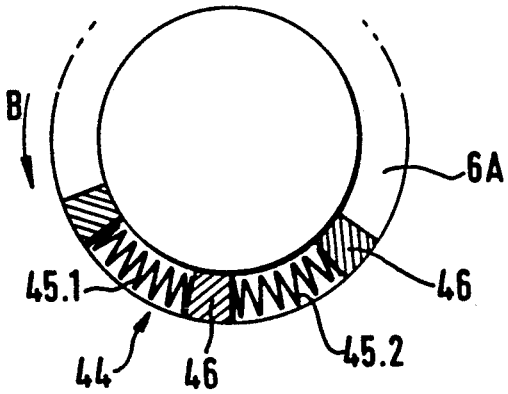
FIG. 11 is a detail partial view of another embodiment of an elastic entraining device.

FIG. 11 shows still another embodiment wherein an entraining element 44 is seated in the receiving space 6A of the clutch drum. The entraining element 44 is configured as a coiled pressure spring. The pressure spring comprises individual springs of which two individual springs 45.1 and 45.2 are schematically shown. A slide body 46 is arranged between each two mutually adjacent individual springs. When the entraining element 44 is loaded in the direction B, the individual spring 45.1 is first pressed together and displaces the slide body 46 which then applies pressure to the individual spring 45.2. The displacement movement is limited by the maximum path of the compression of the individual springs. These individual springs are pressed together to form a block so that their individual turns lie tightly one against the other. The individual springs can also be configured to be barrel-shaped and then comprise spring steel wire. The barrel shape makes it possible to push mutually adjacent turns one inside the other whereby the spring path is greater in comparison to coil springs.

Figure 12:
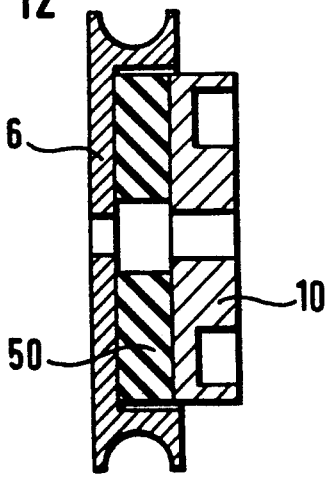
FIG. 12 is a further embodiment of the connection between the clutch drum and the catch carrier via a rubber-elastic entraining element.

In FIG. 12, an especially simple embodiment is shown for the torsion spring connection between the catch carrier 10 and the clutch drum 6. A rubber layer is vulcanized to the catch carrier 10 and to the clutch drum 6 and thereby defines a ring-shaped rubber-elastic entraining element 50. The two end faces are fixedly connected to the base of the catch carrier and to the inner end face of the clutch drum, respectively. An annular gap is left between the peripheral surface of entraining element 50 and the inner wall of the clutch drum. The rubber elastic entraining element 50 deforms with a relative movement between the clutch drum 6 and the catch carrier 10 and is thereby stressed in shear.

Figure 13:
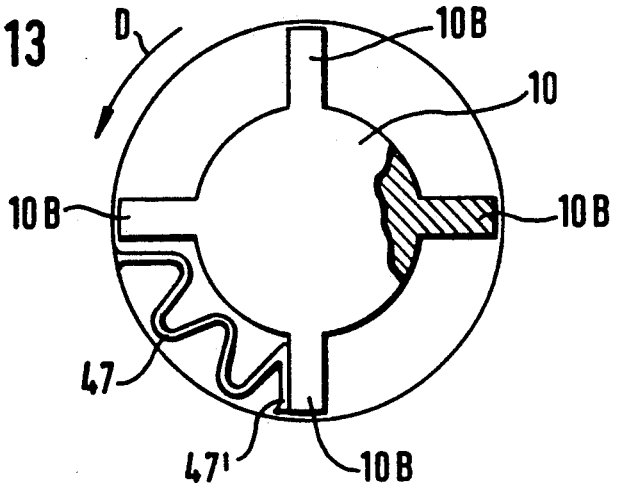
FIG. 13 is an embodiment of an entraining element configured as a folded strip spring.
Figure 14:
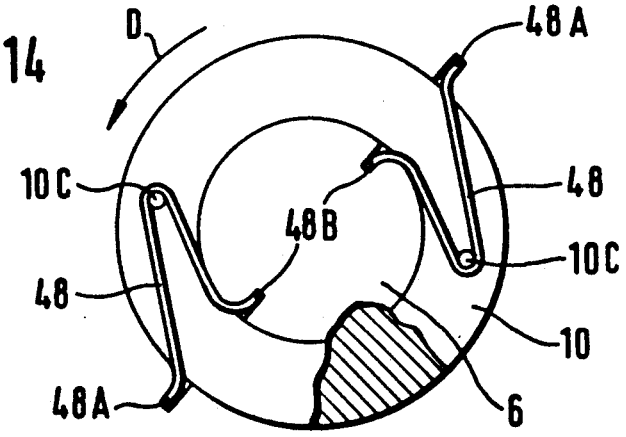
FIG. 14 is a schematic of an entraining element configured as rubber-elastic pull bands; and, FIG. 15 is a schematic showing an entraining element configured as a rubber-elastic hollow body.
Figure 15:
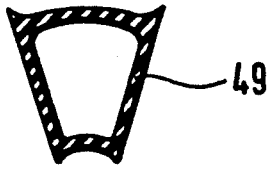

Further embodiments are shown in FIGS. 13, 14 and 15. In FIG. 13, in lieu of a coil spring (FIG. 11), a folded strip spring 47 made of plastic can be used. The strip spring 47 is attached with its end 47' to the end wall 6B of the clutch drum 6 (see FIG. 1) and is, for example, formed to have a point at this end and placed between two inner struts 10B of the catch carrier 10. In the embodiment, four struts 10B are formed on the catch carrier 10 so that four folded strip springs are provided on the clutch drum 6 with the direction of the clutch drum being indicated by arrow D in FIG. 13. In the embodiment of FIG. 14, two rubber-elastic pull bands 48 are used in lieu of the rubber-elastic band 39 (FIG. 9) which lie diametrically opposite each other. Each pull band 48 is attached on radially opposite positions of the clutch drum with its ends 48A and 48B and hooked to a lug 10C of the catch carrier 10. Furthermore, as shown in FIG. 15, rubber hollow bodies 49 can be used in lieu of the solid rubber bodies (FIG. 6 and FIG. 8). The rubber hollow bodies can be filled with gas so that the entraining element is configured as a gas spring.

Most parts of the starting device (FIG. 1) are made of plastic. Accordingly, the housing 1, the spring housing 3, the clutch drum 6, the catch carrier 10 and the catch 11 with pawls 12 and 13 are made of plastic. Manufacture and assembly of the starting device are therefore especially cost-effective.

It is understood that the foregoing description is that of the preferred embodiments of the invention and that various changes and modifications may be made thereto without departing from the spirit and scope of the invention as defined in the appended claims.

I claim:

1. A starting device for applying a starting torque to the shaft of an internal combustion engine with the engine developing a reaction torque during starting which causes said starting torque to fluctuate, the starting device comprising:

a housing;

a clutch arm rotatably journalled in said housing and defining an axis of rotation;

means for manually imparting a rotational movement to said clutch drum;

a clutch member fixedly mounted to the engine shaft for rotation therewith;

a carrier rotatably mounted in said housing so as to be rotatable about said axis;

entraining means for connecting said clutch drum to said carrier for transmitting the rotational movement of said clutch drum to said carrier;

catch means mounted on said carrier and said catch means including a mount on said carrier and two pawls pivotally mounted on said mount so as to be displaceable in response to said rotational movement from a rest position into an engaging position wherein said two pawls engage and transmit said rotational movement to said clutch member; and, said entraining means being elastically deformable to compensate for the fluctuations of said starting torque.

2. The starting device of claim 1, said clutch drum having a circularly-shaped receiving space formed therein for holding said entraining means; and, said entraining means having an end section and said carrier having a projection extending said receiving space for supporting said end section the rotational movement of said clutch drum.

3. The starting device of claim 1, wherein said clutch drum and said carrier move relative to each other about said axis as said entraining means elastically deforms; and, stop means formed on said clutch drum and said carrier for limiting the relative movement therebetween.

4. The starting device of claim 1, said clutch drum having a circularly-shaped receiving space formed therein for holding said entraining means; and, said entraining means comprising a plurality of rubber-elastic bodies disposed one next to the other in said circularly-shaped receiving space so as to be elastically deformable within said receiving space.

5. The starting device of claim 4, said entraining means further comprising a rigid filler body fixedly attached to said clutch drum and disposed next to said plurality of rubber-elastic bodies.

6. The starting device of claim 5, said entraining means further comprising an entraining projection disposed on said carrier and extending into said circularly-shaped receiving space next to said plurality of rubber-elastic bodies; and, said filler body being disposed ahead of said entraining projection when viewed in the direction of said starting torque; and, said filler body being connected with said plurality of rubber-elastic bodies for transmitting the starting torque thereto which is applied to said clutch drum.

7. The starting device of claim 6, said entraining projection and said filler body each having a shape corresponding to a sector of a circle when said clutch drum is viewed in plan.

8. The starting device of claim 7, each of said rubber-elastic bodies likewise having a shape corresponding to a sector of a circle and being disposed in said receiving space so as to be one adjoining the other so as to leave free regions in said receiving space for the elastic deformation of said rubber-elastic bodies.

9. The starting device of claim 1, said clutch drum having a circularly-shaped receiving space formed therein for holding said entraining means; and, said entraining means comprising rubber elastic hollow bodies interposed between said clutch drum and said carrier.

10. The starting device of claim 1, said means for manually imparting said rotational movement to said clutch drum comprising: a pull rope track formed on said clutch drum; spring means for resiliently biasing said clutch drum into a start position; and, a pull rope wound up on said pull rope track when said clutch drum is in said start position.

11. The starting device of claim 1, a bearing lug fixedly mounted on said housing; said clutch drum having an end wall adjacent said carrier and said end wall defining a center bore for receiving said bearing lug therein thereby rotatably journalling said clutch drum thereon; said carrier likewise being rotatably journalled on said bearing lug; and, said catch means further including: a guide bracket for resiliently biasing said pawls into said rest positions thereof; and, said guide bracket being mounted on said bearing lug so as to be frictionally held thereon.

12. A starting device for applying a starting torque to the shaft of an internal combustion engine with the engine developing a reaction torque during starting which causes said starting torque to fluctuate, the starting device comprising:

a housing;

a clutch drum rotatably journalled in said housing and defining an axis of rotation;

means for manually imparting a rotational movement to said clutch drum;

a clutch member fixedly mounted to the engine shaft for rotation therewith;

a carrier rotatably mounted in said housing so as to be rotatable about said axis;

entraining means for connecting said clutch drum to said carrier for transmitting the rotational movement of said clutch drum to said carrier;

catch means mounted on said carrier and being displaceable in response to said rotational movement from a rest position into an engaging position wherein said catch means engages and transmits said rotational movement to said clutch member;

said entraining means being elastically deformable to compensate for the fluctuations of said starting torque;

said clutch drum and said carrier move relative to each other about said axis as said entraining means elastically deforms;

stop means formed on said clutch drum and said carrier for limiting the relative movement therebetween;

said clutch drum having an outer peripheral end face extending transversely to said axis and surrounding said carrier;

said carrier having an outer periphery; and, said stop means including a first stop formed on said end face and a second stop formed on said outer periphery for contact engaging said first stop to limit said relative movement.

13. A starting device for applying a starting torque to the shaft of an internal combustion engine with the engine developing a reaction torque during starting which causes said starting torque to fluctuate, the starting device comprising:

a housing;

a clutch drum rotatably journalled in said housing and defining an axis of rotation;

means for manually imparting a rotational movement to said clutch drum;

a clutch member fixedly mounted to the engine shaft for rotation therewith;

a carrier rotatably mounted in said housing so as to be rotatable about said axis;

entraining means for connecting said clutch drum to said carrier for transmitting the rotational movement of said clutch drum to said carrier;

catch means mounted on said carrier and being displaceable in response to said rotational movement from a rest position into an engaging position wherein said catch means engages and transmits said rotational movement to said clutch member;

said entraining means being elastically deformable to compensate for the fluctuations of said starting torque;

a bearing lug fixedly mounted on said housing;

said clutch drum having an end wall adjacent said carrier and said end wall defining a center bore for receiving said bearing lug therein thereby rotatably journalling said clutch drum thereon;

said carrier likewise being rotatably journalled on said bearing lug; said catch means including a mount on said carrier and two pawls pivotally mounted on said mount for moving between said rest and engaging positions;

a guide bracket for resiliently biasing said pawls into said rest positions thereof; and, said guide bracket being mounted on said bearing lug so as to be frictionally held thereon.

14. A starting device for applying a starting torque to the shaft of an internal combustion engine with the engine developing a reaction torque during starting which causes said starting torque to fluctuate, the starting device comprising:

a housing;

a clutch drum rotatably journalled in said housing and defining an axis of rotation;

means for manually imparting a rotational movement to said clutch drum;

a clutch member fixedly mounted to the engine shaft for rotation therewith;

a carrier rotatably mounted in said housing so as to be rotatable about said axis;

entraining means for connecting said clutch drum to said carrier for transmitting the rotational movement of said clutch drum to said carrier;

catch means mounted on said carrier and being displaceable in response to said rotational movement from a rest position into an engaging position wherein said catch means engages and transmits said rotational movement to said clutch member;

said entraining means being elastically deformable to compensate for the fluctuations of said starting torque;

said clutch drum having a circularly-shaped receiving space formed therein for holding said entraining means;

said entraining means having an end section and said carrier having a projection extending into said receiving space for supporting said end section during the rotational movement of said clutch drum;

said carrier being a dish-shaped carrier seated in said receiving space of said clutch drum with slight play;

said carrier having a base recessed in said clutch drum and a side wall;

said carrier means including a bearing mount fixedly disposed on said base and two pawls pivotally mounted on said bearing mount for moving between said rest and engaging positions;

said bearing mount and said side wall conjointly defining an annular space wherein said pawls move between said positions; and, said clutch member having engaging means disposed in said annular space for coacting with said pawls when said pawls are in said engaging position.

15. A starting device for applying a starting torque to the shaft of an internal combustion engine with the engine developing a reaction torque during starting which causes said starting torque to fluctuate, the starting device comprising:

a housing;

a clutch drum rotatably journalled in said housing and defining an axis of rotation;

means for manually imparting a rotational movement to said clutch drum;

a clutch member fixedly mounted to the engine shaft for rotation therewith;

a carrier rotatably mounted in said housing so as to be rotatable about said axis;

entraining means for connecting said clutch drum to said carrier for transmitting the rotational movement of said clutch drum to said carrier;

catch means mounted on said carrier and being displaceable in response to said rotational movement from a rest position into an engaging position wherein said catch means engages and transmits said rotational movement to said clutch member;

said entraining means being elastically deformable to compensate for the fluctuations of said starting torque;

said clutch drum having a circularly-shaped receiving space formed therein for holding said entraining means;

said entraining means having an end section and said carrier having a projection extending into said receiving space for supporting said end section during the rotational movement of said clutch drum;

said clutch drum having a base wall and a side wall extending from said base wall to define said circularly-shaped receiving space; and, said side wall having a ring-shaped shoulder formed thereon defining a seating surface for receiving said carrier thereon.

16. The starting device of claim 15, said entraining means being a spiral spring having first and second ends connected to said clutch drum and said carrier, respectively.

17. The starting device of claim 16, said end section having said second end formed thereon and said second end being an inner bent-over end piece; said projection being concentric with said axis and having a spirally shaped surface for receiving said end section thereon; said projection having an axial slot formed therein for receiving said bent-over end piece therein; said first end of said spiral spring being an outer end having a bent-over end piece; and, said side wall defining a slit for receiving said bent-over end piece of said outer end therein.

18. The starting device of claim 17, said spiral spring being pretensioned in the direction of said starting torque.

19. The starting device of claim 18, said spiral spring having an outer turn lying in contact engagement with said ring-shaped shoulder when said spiral spring is in the relaxed state thereof.

20. The starting device of claim 15, said entraining means being made at least partially of elastomer.

21. A starting device for applying a starting torque to the shaft of an internal combustion engine with the engine developing a reaction torque during starting which causes said starting torque to fluctuate, the starting device comprising:

a housing;

a clutch drum rotatably journalled i said housing and defining an axis of rotation;

means for manually imparting a rotational movement to said clutch drum;

a clutch member fixedly mounted to the engine shaft for rotation therewith;

a carrier rotatably mounted in said housing so as to be rotatable about said axis;

entraining means for connecting said clutch drum to said carrier for transmitting the rotational movement of said clutch drum to said carrier;

catch means mounted on said carrier and being displaceable in response to said rotational movement from a rest position into an engaging position wherein said catch means engages and transmits said rotational movement to said clutch member;

said entraining means being elastically deformable to compensate for the fluctuations of said starting torque;

said clutch drum having a circularly-shaped receiving space formed therein for holding said entraining means;

said entraining means comprising a plurality of rubber-elastic bodies disposed one next to the other in said circularly-shaped receiving space so as to be elastically deformable within said receiving space;

said entraining means further including a rigid filler body fixedly attached to said clutch drum and disposed next to said plurality of rubber-elastic bodies;

said entraining means further including an entraining projection disposed on said carrier and extending into said circularly-shaped receiving space next to said plurality of rubber-elastic bodies;

said filler body being disposed ahead of said entraining projection when viewed in the direction of said starting torque;

said filler body being connected with said plurality of rubber-elastic bodies for transmitting the starting torque thereto which is applied to said clutch drum;

said entraining projection and said filler body each having a shape corresponding to a sector of a circle when said clutch drum is viewed in plan;

each of said rubber-elastic bodies likewise having a shape corresponding to a sector of a circle and being disposed in said receiving space so as to be one adjoining the other so as to leave free regions in said receiving space for the elastic deformation of said rubber-elastic bodies; and, each of said rubber-elastic bodies comprising a holder and rubber element held by said holder.

22. The starting device of claim 21, said holder of each of said rubber-elastic bodies including two plates disposed radially to said clutch drum; and, said plates being attached to said rubber element at respective lateral sides thereof.

23. The starting device of claim 22, each of said rubber elements having cutouts formed therein for obtaining a pregiven form elasticity.

24. A starting device for applying a starting torque to the shaft of an internal combustion engine with the engine developing a reaction torque during starting which causes said starting torque to fluctuate, the starting device comprising:

a housing;

a clutch drum rotatably journalled in said housing and defining an axis of rotation;

means for manually imparting a rotational movement to said clutch drum;

a clutch member fixedly mounted to the engine shaft for rotation therewith;

a carrier rotatably mounted in said housing so as to be rotatable about said axis;

entraining means for connecting said clutch drum to said carrier for transmitting the rotational movement of said clutch drum to said carrier;

catch means mounted on said carrier and being displaceable in response to said rotational movement from a rest position into an engaging position wherein said catch means engages and transmits said rotational movement to said clutch member;

said entraining means being elastically deformable to compensate for the fluctuations of said starting torque;

said clutch drum having a circularly-shaped receiving space formed therein for holding said entraining means;

said entraining means including a plurality of rubber-elastic bodies disposed one next to the other in said circularly-shaped receiving space so as to be elastically deformable within said receiving space;

said entraining means including an annular carrying body having a plurality of carrying rods extending radially outwardly;

said carrying rods having respective outer free ends;

a plurality of rubber-elastic bodies attached to corresponding ones of said outer free ends; and, each of said rubber-elastic bodies being arranged at a spacing from the next adjacent one of said rods.

25. The starting device of claim 24, said carrying body, said carrying rods and said rubber-elastic bodies being made of elastic plastic.

26. A starting device for applying a starting torque to the shaft of an internal combustion engine with the engine developing a reaction torque during starting which causes said starting torque to fluctuate, the starting device comprising:

a housing;

a clutch drum rotatably journalled in said housing and defining an axis of rotation;

means for manually imparting a rotational movement to said clutch drum;

a clutch member fixedly mounted to the engine shaft for rotation therewith;

a carrier rotatably mounted in said housing so as to be rotatable about said axis;

entraining means for connecting said clutch drum to said carrier for transmitting the rotational movement of said clutch drum to said carrier;

catch means mounted on said carrier and being displaceable in response to said rotational movement from a rest position into an engaging position wherein said catch means engages and transmits said rotational movement to said clutch member;

said entraining means being electrically deformable to compensate for the fluctuations of said starting torque;

said clutch drum having a circularly-shaped receiving space formed therein for holding said entraining means;

said clutch drum having a bearing position thereon and said carrier having a projection formed thereon; and, said entraining means including: an annularly-shaped rubber band; a plurality of carrying rings attached to said rubber band and disposed one next to the other; and, said rubber band being held between said bearing position and said projection.

27. A starting device for applying a starting torque to the shaft of an internal combustion engine with the engine developing a reaction torque during starting which causes said starting torque to fluctuate, the starting device comprising:

a housing;

a clutch drum rotatably journalled in said housing and defining an axis of rotation;

means for manually imparting a rotational movement to said clutch drum;

a clutch member fixedly mounted to the engine shaft for rotation therewith;

a carrier rotatably mounted in said housing so as to be rotatable about said axis;

entraining means for connecting said clutch drum to said carrier for transmitting the rotational movement of said clutch drum to said carrier;

catch means mounted on said carrier and being displaceable in response to said rotational movement from a rest position into an engaging position wherein said catch means engages and transmits said rotational movement to said clutch member;

said entraining means being elastically deformable to compensate for the fluctuations of said starting torque;

said clutch drum having a circularly-shaped receiving space formed therein for holding said entraining means;

said clutch drum having a radial support surface;

said entraining means being coil spring means disposed in said receiving space along at least a segment of a circle concentric to said axis;

said carrier having a projection formed thereon; and, said coil spring means being clamped between said radial support surface and said projection.

28. The starting device of claim 27, said coil spring means comprising a plurality of individual coil springs and a plurality of slide bodies; and, one of said slide bodies being disposed between each two mutually adjacent ones of said slide bodies.

29. The starting device of claim 28, said individual coil springs being respective barrel coil springs.

30. The starting device of claim 27, said clutch drum having a circularly-shaped receiving space formed therein for holding said entraining means; and, said clutch drum having a base wall and a side wall extending from said base wall to define said circularly-shaped receiving space.

31. A starting device for applying a starting torque to the shaft of an internal combustion engine with the engine developing a reaction torque during starting which causes said starting torque to fluctuate, the starting device comprising:

a housing;

a clutch drum rotatably journalled in said housing and defining an axis of rotation;

means for manually imparting a rotational movement to said clutch drum;

a clutch member fixedly mounted to the engine shaft for rotation therewith;

a carrier rotatably mounted in said housing so as to be rotatable about said axis;

entraining means for connecting said clutch drum to said carrier for transmitting the rotational movement of said clutch drum to said carrier;

catch means mounted on said carrier and being displaceable in response to said rotational movement from a rest position into an engaging position wherein said catch means engages and transmits said rotational movement to said clutch member;

said entraining means being elastically deformable to compensate for the fluctuations of said starting torque;

said clutch drum having a circularly-shaped receiving space formed therein for holding said entraining means; and, said entraining means including: an entraining strut formed on said carrier; and, a plastic folded strip spring braced on said entraining strut and connected to said clutch drum.

32. The starting device of claim 31, said clutch drum having a circularly-shaped receiving space formed therein for holding said entraining means; and, said clutch drum having a base wall and a side wall extending from said base wall to define said circularly-shaped receiving space.

33. A starting device for applying a starting torque to the shaft of an internal combustion engine with the engine developing a reaction torque during starting which causes said starting torque to fluctuate, the starting device comprising:

a housing;

a clutch drum rotatably journalled in said housing and defining an axis of rotation;

means for manually imparting a rotational movement to said clutch drum;

a clutch member fixedly mounted to the engine shaft for rotation therewith;

a carrier rotatably mounted in said housing so as to be rotatable about said axis;

entraining means for connecting said clutch drum to said carrier for transmitting the rotational movement of said clutch drum to said carrier;

catch means mounted on said carrier and being displaceable in response to said rotational movement from a rest position into an engaging position wherein said catch means engages and transmits said rotational movement to said clutch member;

said entraining means being elastically deformable to compensate for the fluctuations of said starting torque;

said clutch drum having a circularly-shaped receiving space formed therein for holding said entraining means; and, said entraining means including: an elastic pull band having first and second ends connected at radially opposite locations, respectively, of said clutch drum; and, a lug mounted on said carrier and said pull band being in pull contact with said lug so as to pass over said lug.

34. A starting device for applying a starting torque to the shaft of an internal combustion engine with the engine developing a reaction torque during starting which causes said starting torque to fluctuate, the starting device comprising:

a housing;

a clutch drum rotatably journalled in said housing and defining an axis of rotation;

means for manually imparting a rotational movement to said clutch drum;

a clutch member fixedly mounted to the engine shaft for rotation therewith;

a carrier rotatably mounted in said housing so as to be rotatable about said axis;

entraining means for connecting said clutch drum to said carrier for transmitting the rotational movement of said clutch drum to said carrier;

catch means mounted on said carrier and being displaceable in response to said rotational movement from a rest position into an engaging position wherein said catch means engages and transmits said rotational movement to said clutch member;

said entraining means being elastically deformable to compensate for the fluctuations of said starting torque;

said clutch drum having a circularly-shaped receiving space formed therein for holding said entraining means;

said carrier having a base and said clutch drum having an inner end face; and, said entraining means including an annular rubber-elastic layer connected to said base and said inner end face by vulcanizing said layer to said base and said inner end face.

35. A starting device for applying a starting torque to the shaft of an internal combustion engine with the engine developing a reaction torque during starting which causes said starting torque to fluctuate, the starting device comprising:

a housing;

a clutch drum rotatably journalled in said housing and defining an axis of rotation;

means for manually imparting a rotational movement to said clutch drum;

a clutch member fixedly mounted to the engine shaft for rotation therewith;

a carrier rotatably mounted in said housing so as to be rotatable about said axis;

a spiral spring for connecting said clutch drum to said carrier for transmitting the rotational movement of said clutch drum to said carrier;

said spiral spring having first and second ends connected to said clutch drum and said carrier, respectively;

said clutch drum having a circularly-shaped receiving space formed therein for holding said spiral spring;

said clutch drum having a base wall and a side wall extending from said base wall to define said circularly-shaped receiving space;

catch means mounted on said carrier and being displaceable in response to said rotational movement from a rest position into an engaging position wherein said catch means engages and transmits said rotational movement to said clutch member; and, said spiral spring being elastically deformable to compensate for the fluctuations of said starting torque.

36. A starting device for applying a starting torque to the shaft of an internal combustion engine with the engine developing a reaction torque during starting which causes said starting torque to fluctuate, the starting device comprising:

a housing;

a clutch drum rotatably journalled in said housing and defining an axis of rotation;

means for manually imparting a rotational movement to said clutch drum;

a clutch member fixedly mounted to the engine shaft for rotation therewith;

a carrier rotatably mounted in said housing so as to be rotatable about said axis;

elastomer entraining means for connecting said clutch drum to said carrier for transmitting the rotational movement of said clutch drum to said carrier;

said clutch drum having a circularly-shaped receiving space formed therein for holding said elastomer entraining means;

said clutch drum having a base wall and a side wall extending from said base wall to define said circularly-shaped receiving space;

catch means mounted on said carrier and said catch means including a mount on said carrier and two pawls pivotally mounted on said mount so as to be displaceable in response to said rotational movement from a rest position into an engaging position wherein said two pawls engage and transmit said rotational movement to said clutch member; and, said elastomer entraining means being elastically deformable to compensate for the fluctuations of said starting torque.

* * * * *

UNITED STATES PATENT AND TRADEMARK OFFICE

CERTIFICATE OF CORRECTION

PATENT NO. : 5,287,832

DATED : February 22, 1994

INVENTOR(S) : Klaus-Martin Uhl

It is certified that error appears in the above-identified patent and that said Letters Patent is hereby corrected as shown below:

On the title page, under U.S. PATENT DOCUMENTS: delete "Prers" and substitute -- Frers -- therefor.

In column 7, line 5: delete "30.1," and substitute -- 30.1', -- therefor.

In column 8, line 26: delete "arm" and substitute -- drum -- therefor.

In column 8, line 51: between "extending" and "said", insert -- into --.

In column 8, line 52: between "section" and "the", insert -- during --.

In column 12, line 39: delete "i" and substitute -- in -- therefor.

In column 14, line 29: delete "electrically" and substitute -- elastically -- therefor.

Signed and Sealed this

Twenty-first Day of June, 1994

*Attest:*

Bruce Lehman

BRUCE LEHMAN

*Attesting Officer*

*Commissioner of Patents and Trademarks*